United States Patent [19]

Strandberg

[11] 4,428,410

[45] Jan. 31, 1984

[54] METHOD FOR COMPRESSING WOODEN ELEMENTS

[75] Inventor: Anders Strandberg, Eskilstuna, Sweden

[73] Assignee: AB Nils Darje, Ljusdal, Sweden

[21] Appl. No.: 394,928

[22] PCT Filed: Oct. 8, 1981

[86] PCT No.: PCT/SE81/00289

§ 371 Date: Jun. 28, 1982

§ 102(e) Date: Jun. 28, 1982

[87] PCT Pub. No.: WO82/01504

PCT Pub. Date: May 13, 1982

[30] Foreign Application Priority Data

Mar. 24, 1981 [SE] Sweden ..... 8101862

[51] Int. Cl.[3] ..... B27M 1/02

[52] U.S. Cl. ..... 144/361

[58] Field of Search ..... 144/361, 362, 329, 359

[56] References Cited

U.S. PATENT DOCUMENTS

| | | | |
|---|---|---|---|
| 1,403,722 | 1/1922 | Turnbull . | |
| 1,644,801 | 10/1927 | Van Der Werff | 144/361 |
| 1,952,664 | 3/1934 | Esselen . | |
| 2,136,730 | 11/1938 | Sweetland . | |
| 2,666,463 | 1/1954 | Heritage . | |
| 2,974,697 | 3/1961 | Elmendorf et al. . | |

FOREIGN PATENT DOCUMENTS

| | | |
|---|---|---|
| 601162 | 11/1930 | Fed. Rep. of Germany . |
| 1075821 | 2/1960 | Fed. Rep. of Germany . |
| 2112618 | 9/1972 | Fed. Rep. of Germany . |
| 104506 | 5/1942 | Sweden . |
| 7805483 | 5/1978 | Sweden . |

*Primary Examiner*—W. D. Bray

*Attorney, Agent, or Firm*—Spencer & Frank

[57] ABSTRACT

A method of compressing at least one flat wooden element having knots therein to permanently increase the hardness of the wooden element. The method includes the steps of inserting an elastic material layer between a pair of spaced apart press plates which are moveable with respect to each other, the elastic material layer being softer than the wooden element. The wooden element is then interposed between the elastic material and one of the press plates, and the pair of press plates displaced toward each to a predetermined spacing thereby compressing the entire surface of the wooden element and elastic material layer, the thickness of the elastic material layer in the compressed state being at least one-half the thickness of the compressed wooden element. Portions of the knots in the wooden element are forced out of the element and into the elastic material layer without being broken to shivers by the pressure exerted thereon. The portions of the knots projecting from the surface of the wooden element and received in the pad during the displacement step are then removed.

4 Claims, 4 Drawing Figures

METHOD FOR COMPRESSING WOODEN ELEMENTS

FIELD OF THE INVENTION

This invention relates to a method for compressing board-shaped or otherwise flat wooden elements in order to produce a remaining compression of the wood and thereby permanently increase the hardness thereof. In particular the invention is applicable to comparatively soft wood such as pinewood and whitewood.

DESCRIPTION OF THE PRIOR ART

German patent specification No. 601162 and U.S. Pat. Nos. 1,403,722 and 2,666,463 disclose that it has been previously known to compress wooden elements to increase the hardness and the mechanical strength thereof. This is done quite simply by introducing the elements in question one by one between two mutually moveable press plates and subjecting them to an appropriate pressure.

The prior art technique such as represented not only by the above-mentioned patent specifications but also by Swedish patent application No. 7805483-0 is however limited to the use of uniform knotless wood; a material which on one hand fetches a high price and on the other is not desirable on the whole within many fields of application, since knots usually lend a characteristic, vivid and aesthetically attractive appearance to the wood. This limitation to the expensive, aesthetically not very striking wood qualities that are knotless has led to the fact that the technique in question has been carried into effect to an extremely small extent in practice.

Swedish patent specification No. 104506 discloses a method of compressing wooden elements at high pressures between reciprocating press plates. These elements are however not board-shaped or flat but consist of irregularly split logs which are charged to the press device at random without any specific knot-receiving layer between each element and the adjacent press plate. The logs treated in accordance with this method are moreover intended for the production of pulp, while the board elements treated in accordance with the present invention are intended to be used e.g. in floors, as furniture components, etc.

German patent specification No. 1075821 discloses how a plurality of flat wooden elements or boards are pressed together between two reciprocating press plates. The pressure used in this process is, however, extremely mediocre and not at all sufficient to produce a permanent compression completely throughout the wood material while reducing the thickness thereof by 30 to 50% or even to bring about the slightest tendency of any knots to come out of the surface of the board.

U.S. Pat. No. 2,974,697 and German Offenlegungsschrift No. 2112618 disclose how wooden elements are treated by being fed between rollers. None of these publications deals with the problem of keeping the knots of the wood intact during pressing. Quite to the contrary the Offenlegungsschrift No. 2112618 aims at eliminating the knots by crushing them during the pressing between the rollers.

SUMMARY OF THE INVENTION

An object of the present invention is to make it possible to compress even wood which is full of knots and thereby provide wooden elements having good impact and scratch resistance properties. According to the invention this is achieved by means of a method which is characterized by the steps of subjecting the individual wooden element to a pressure in the region of 20 to 60 MPa (Mega Pascal) during pressing between two press plates which are moveable relative to each other in a manner known per se and keeping it therebetween together with at least one layer of material, the hardness of which is less than the hardness of the knots existing in the element in question and which layer is thick enough to allow portions of the knots to be forced out of said element and into said layer without breaking to shivers by the pressure exerted.

By using a pressure in the region of 20 to 60 MPa, preferably 30 to 40 MPa, a substantially homogeneous compression throughout the wood material is achieved, leading to a permanent decrease in the thickness of ordinary wood amounting to 30 to 50%. At the same time the knots remain perfectly undestroyed due to the fact that they are not compressed directly between the two press plates of hard material, but are accomodated in said receiving layer consisting of a material which is softer than the knots themselves. The portions of the knots that will thereby project from a surface of the wooden element thus treated may later on either be removed, e.g. by grinding, or quite simply be left in unchanged condition so as to be subsequently pressed into suitable supports consisting of a comparatively soft material, e.g. in connection with fixing the wooden element to the support by gluing.

DESCRIPTION OF THE PREFERRED EMBODIMENT

Figure 1:
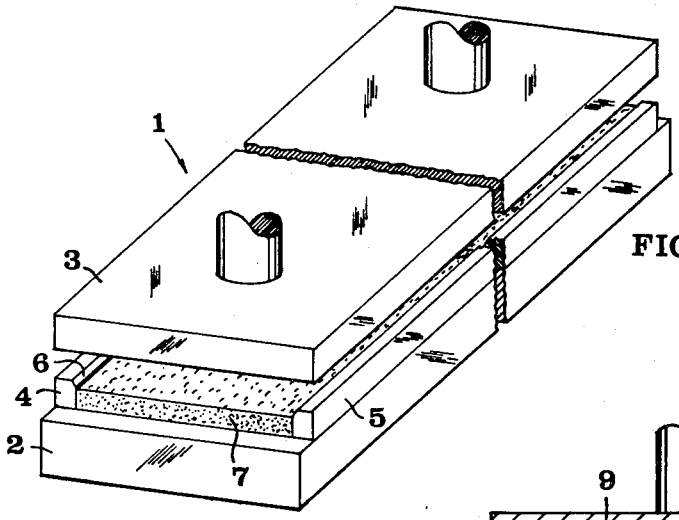
FIG. 1 is a partially cut perspective view of a preferred embodiment of the press device used for carrying out the method of the invention.
Figure 2:
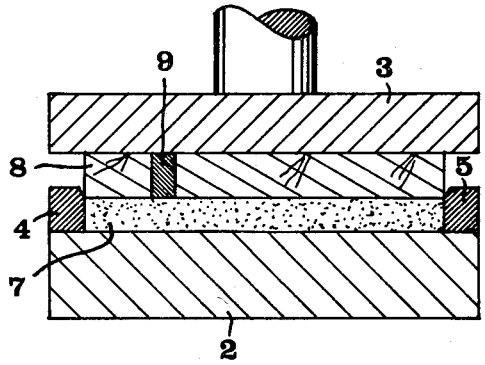
FIG. 2 is a cross-section along the lines II—II of FIG. 1 showing a board to be treated.
Figure 3:
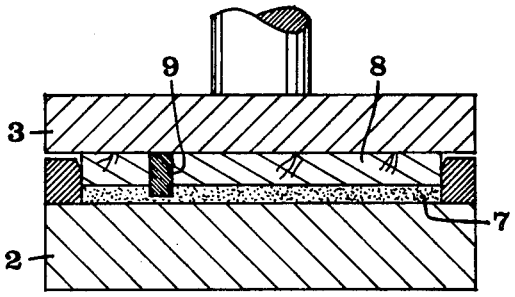
FIG. 3 is a similar cross-section illustrating the same board during the pressing treatment.

The press device 1 shown in FIGS. 1 to 3 comprises in the conventional manner two press members of hard material, such as steel, which are moveable in relation to each other. More exactly said members consist of a stationary plate or table 2 and a press plate 3 which is vertically moveable to and fro in relation to the table. The plate can be subjected to a press force of suitable magnitude in any arbitrary manner (not illustrated). On one of the press members, in this case on the table 2, two limiting members 4,5 in the form of long borders or bars are provided, said members being fixed to the table in any arbitrary manner, e.g. by means of screws, welds or the like. At their upper and inner edges the borders 4,5 present chamferred surfaces 6 the purpose of which is to facilitate the introduction of a board between the borders. FIG. 1 illustrates the fact that no end limiting means are provided between the borders 4,5 meaning that between said borders a board receiving space is confined which is open at the opposite ends thereof.

FIG. 1 further shows that a pad 7 is located between the two side limiting borders, said pad being intended to form a bed for the board to be received. In accordance with the invention this pad consists of plastic or rubber, preferably neoprene; that is, a material the hardness of which is less than the hardness of the knots included in the boards to be pressed. In this connection the definition "hardness" should be construed not only as the Brinell-hardness but also as the modulus of elasticity of the materials in question, i.e. both of these magnitudes of the material of the pad 7 should be positively smaller than the corresponding magnitudes of the knots. Another important criterion of the pad 7 is that it should have a sufficient thickness in relation to its own elasticity characteristics and the pressure exerted to be able to accomodate knot portions of considerable sizes even when the pad itself is compressed.

Now reference is made to FIGS. 2 and 3 which illustrate the various steps during a pressing operation. FIG. 2 shows how the press device is charged by introducing a board 8 between the table 2 and the press plate 3 and letting the board rest on the elastic pad 7. This introduction is facilitated by the chamferings 6. Thereafter, the plate 3 is subjected to a press force which, after having brought said plate to the initial position shown in FIG. 2, initiates a pressing work during which the board 8 as well as the pad 7 are subjected to a pressure of suitable magnitude and duration, said work being terminated in the phase illustrated in FIG. 3. In the next phase the pressure is reduced and the plate 3 is caused to return to the rest position of FIG. 2 in which the pressing cycle or operation is terminated.

According to tests performed the maximum pressure that may occur during the above-mentioned cycle should not greatly exceed 60 MPa (8700 psi). On the other hand the pressure should not be less than 20 MPa (2900 psi). Preferably the active pressure is within the region of 30 to 40 MPa in connection with the compression of such comparatively soft and porous sorts of wood as pinewood and whitewood (dry weights by unit of volume approximately 0.49 and 0.43 kg/dm$^3$ respectively). In connection with harder sorts of wood higher pressures may be used, while softer sorts of wood may require lower pressures. Tests have further shown that the pressing without disadvantage may be carried out instantaneously or substantially instantaneously, i.e. the press plate 3 may be moved with a suitable speed without interrruptions from the initial position shown in FIG. 2, turned and removed back to the point where the plate leaves the board 8.

Under the above-mentioned conditions it is possible to achieve a permanent compression of the treated board amounting to 30 to 50%, i.e. a board the thickness of which is e.g. 10 mm will be compressed to a thickness of 7 to 5 mm. The pressing method described is particularly applicable to so called "thin-boards", i.e. flat wooden elements which are relatively wide and long and on one hand are positively thinner than conventional sawngoods (usually 20 mm or more) and on the other thicker than veneer of the usual type (1 to 3 mm). Thus the sizes of the starting material, that is the boards to be introduced into the press device of FIG. 2, may advantageously amount to 5 to 15 mm in thickness while the width amounts to minimum 120 mm. In this connection it should be noted that the board shown in the drawing for the sake of saving space in the drawing has been given an exaggerated thickness in relation to the width.

The process of squeezing knots out of the proper board 8 taking place in accordance with the invention is illustrated in the drawing by the single knot 9, though it should be understood that each board may include a great number of such knots.

The material of the pad 7 which, by its relative softness or elasticity, is able to accomodate the projecting portion of the knot 9 should preferably be homogeneous or structurally uniform. In practice the pad may consist of neoprene though other suitable elastic material from the group consisting of rubber or plastics may also be used. The material should be selected so that the pad 7 in its compressed condition (see FIG. 3) will have a thickness amounting to at least 50% of the thickness of the board in its compressed condition. Otherwise there is a risk that the knots will be split. From FIG. 3, it further appears that the total thickness of the pad 7 and the board 8 when compressed to a maximum is at least slightly greater than the height or thickness of the limiting borders 4,5 so that these cannot be used safely as spacing means between the press members 2 and 3.

Due to its elastic nature the pad 7 will to a certain extent act as a spring that presses up or tends to press the board up out of the space between the borders when the pressing operation is finished.

In the press device shown, boards having a predetermined standard width are compressed, either one single long board or a plurality of shorter boards being treated on each occasion. If it is desirable to adapt the device to varying board widths it is of course possible to mount at least one of the borders detachably on the table so as to be adjusted to another width.

Figure 4:
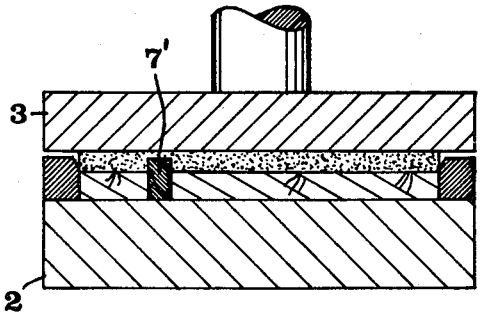
FIG. 4 is an analogous cross-section showing an alternative embodiment of the invention.

FIG. 4 illustrates an alternative embodiment of the invention in which a pad 7' is connected to the moveable press plate 3 instead of being attached to the stationary table 2. An advantage of this embodiment is that the projecting knot portions squeezed out will be directed upwardly from the lying board. In a line production this will facilitate the removal of said knot portions, e.g. by grinding, since then the board does not have to be turned before the grinding operation.

The boards or wooden elements treated in accordance with the present invention are well suited to be used as surface forming members in floors, said floors attaining excellent properties regarding impact and scratch resistance in comparison with floors made from conventional softwood, such as pinewood or whitewood, while at the same time fully maintaining the attractive appearance of wood which may be rich in knots. They may also be used as surface forming members in tables or any arbitrary furniture objects needing good-looking and resistent surfaces. In all applications the boards compressed may be mounted together on a common support consisting of a cheaper material, such as fibre board, thereby providing economical production.

It is possible to treat during a single pressing operation in one and the same press device two or more wooden elements arranged in layers one above the other, thereby increasing the capacity of the device. In this case one introduces between the two press members a packet built up from a first pad, a first wooden element, a first hard insert plate (e.g. a steel plate), a second pad, a second wooden element, a second hard insert plate, etc, to the height desired.

I claim:

1. The method of compressing at least one flat wooden element having knots therein comprising the steps of:

inserting an elastic material layer between a pair of spaced-apart press plates which are moveable with respect to each other, said elastic material layer being softer than said wooden element;

interposing said wooden element between said elastic material layer and one of said press plates;

displacing said pair of press plates toward each to a predetermined spacing thereby compressing the entire surface of said wooden element and elastic material layer, the thickness of said elastic material layer in the compressed state being at least one-half the thickness of the compressed wooden element, portions of the knots in said wooden element being forced out of said element and into said elastic material layer without breaking to shivers by the pressure exerted thereon; and removing the portions of said knots projecting from the surface of said wooden element and received in said pad during said displacing step.

2. The method according to claim 1 wherein a plurality of wooden elements are simultaneously compressed between said press plates, said press plates being composed of metal; and wherein an elastic material layer is provided between each of said plurality of wooden elements and a press plate.

3. The method according to claim 1 wherein said elastic material layer comprises a pad composed of a material selected from the group consisting essentially of plastics and rubber.

4. The method according to claim 3 wherein said elastic material is composed of neoprene.

* * * * *